US006917015B2

(12) United States Patent
Choo

(10) Patent No.: US 6,917,015 B2
(45) Date of Patent: Jul. 12, 2005

(54) ELECTRIC IRON ARRANGEMENT

(75) Inventor: Ban Nee Choo, Singapore (SG)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 10/480,128

(22) PCT Filed: Jun. 10, 2002

(86) PCT No.: PCT/IB02/02184

§ 371 (c)(1),
(2), (4) Date: Dec. 9, 2003

(87) PCT Pub. No.: WO02/101138

PCT Pub. Date: Dec. 19, 2002

(65) Prior Publication Data

US 2004/0217101 A1 Nov. 4, 2004

(30) Foreign Application Priority Data

Jun. 12, 2001 (SG) ..... 2001037514

(51) Int. Cl.[7] ..... D06F 75/28

(52) U.S. Cl. ..... 219/247; 219/246; 219/256; 219/259; 38/77.3; 38/78.82; 38/88; 38/94

(58) Field of Search ..... 219/246, 247, 219/256, 259; 38/75, 77.3, 77.7, 78.82, 88, 96, 85, 77.5, 77.9, 79, 94, 77.6

(56) References Cited

U.S. PATENT DOCUMENTS 5,142,124 A * 8/1992 Driessen ..... 219/247
5,428,910 A * 7/1995 Gudefin et al. ..... 38/77.6

* cited by examiner

*Primary Examiner*—Shawntina Fuqua

(57) ABSTRACT

An arrangement including an electric iron having a water tank, a steam chamber, and valve for controlling the water flow from the water tank to the steam chamber, a stand for supporting the iron, an electrical connector, and a locking mechanism for locking the connector to the stand or to the iron. When the cordless mode is selected, the electrical connector remains attached to the stand while the iron is detached therefrom, and when the corded mode is selected the connector remains attached to the iron while the iron is detachable from the stand. The arrangement is provided with an actuator acting on the valve for obtaining a higher maximum water flow rate in the corded mode than in the cordless mode. The actuator may be a spring-loaded push rod arranged in the iron, one end thereof cooperating with the connector and the other end thereof cooperating with the valve.

13 Claims, 6 Drawing Sheets

ELECTRIC IRON ARRANGEMENT

The invention relates to an electric iron arrangement to be used as desired in either a corded mode or a cordless mode, the arrangement comprising an electric iron having a housing, a water tank, a steam chamber, valve means for controlling the water flow from the water tank to the steam chamber, and electrical contacts through which heating means of the iron can be energized, a stand for supporting the iron when not in use, an electrical connector having a housing, an electric power cord, and electrical contacts energizable by means of the power cord and constructed to cooperate with the electrical contacts of the iron when the iron and the connector are in an interengaged position, and locking means for locking the connector to the stand or to the iron, the arrangement being such that, when the cordless mode is selected, the electrical connector remains attached to the stand while the iron is detached therefrom, and when the corded mode is selected the connector remains attached to the iron while the iron is detachable from the stand.

Such an iron arrangement is known from EP-A-0379259. In corded/cordless iron arrangements known up to now, the iron can be used either as a cordless iron, in which case the iron is not connected to the power source, or as a corded iron, in which case the iron is connected to a power source by means of a power cord. The energy available in such an iron is used for heating the soleplate. If the iron is also suitable for generating steam, the maximum steam rate is determined by the amount of energy that can be stored in the iron. This means that, when the iron is used as a corded iron, the maximum steam rate is the same as when the iron is used as a cordless iron, although the maximum steam rate could be much higher in the corded mode because the iron is connected to the mains and thus more energy is available.

It is an object of the invention to provide the arrangement with means for achieving a higher steam rate in the corded mode than in the cordless mode.

To this end the arrangement is provided with means acting on the valve means for obtaining a higher maximum water flow rate in the corded mode than in the cordless mode.

It is achieved with said means that the maximum size of an opening or a passage between the water tank and the steam chamber, which is controlled by the valve means, is larger in the corded mode than in the cordless mode. More water flowing into the steam chamber means that more steam can be generated.

A preferred embodiment of the iron arrangement is characterized in that the actuating means comprise a spring-loaded push rod arranged in the iron, one end thereof cooperating with the connector, the other end thereof cooperating with the valve means. When the corded mode is selected, i.e. when the connector is attached to the iron, the push rod moves automatically from a first into a second position, causing a larger opening or passage to be formed between the water tank and the steam chamber. Selecting the cordless mode returns the push rod to the first position, thus causing a smaller opening or passage.

It is possible to activate the push rod in such a manner that said one end abuts against a housing wall of the connector. However, the push rod will be activated every time the iron is put back on the stand in the cordless mode because said one end of the push rod abuts against the housing wall of the connector, whereas this should have been only necessary in the corded mode. Therefore, a further embodiment is characterized in that said one end of the push rod cooperates with the locking means for the connector. In the corded mode the connector is locked to the iron through actuation of the locking means. This actuation of the locking means causes an automatic movement of the push rod from the first into the second position. Upon unlocking of the connector, the push rod returns to the first position. The advantage of this is that, when the cordless mode is selected, the push rod is not activated when the iron is positioned back on the stand (connector) for recharging. This increases the lifetime of the actuating means. A particular embodiment of this is characterized in that the locking means comprise latches, each latch being movable through a corresponding opening in a housing of the connector inside a corresponding opening in the housing of the iron, and in that one of the latches cooperates with said one end of the push rod. A pivotable movement of the latches may be obtained, for example, by means of an operating knob on the stand.

A further preferred embodiment is characterized in that the valve means comprise a movable steam rod with a steam needle and a valve seat defining an opening in which the steam needle is inserted, the water flow from the water tank to the steam chamber being determined by the position of the steam needle in said opening, and the position of the steam needle being dependent on the position of the push rod. It is well known from irons to control the flow of water from the water tank to the steam chamber by means of adjusting the position of the steam needle in an opening of the valve seat. According to this embodiment, the position of the steam needle at a maximum water flow is now determined by the position of the push rod in the corded mode as well as in the cordless mode.

A further embodiment of the above embodiment is characterized in that the actuating means comprise converter means for converting the movement of the push rod into a translation or rotation of the steam rod. Examples of such converter means will be described in a detailed description of several embodiments hereinafter.

Independently of whether the corded or cordless mode is selected, the water flow from the water tank to the steam chamber can be adjusted by means of a control knob on the iron. So the steam production is adjustable in the corded mode as well as in the cordless mode. The difference is that in the corded mode the maximum steam production is higher that in the cordless mode.

These and other aspects of the invention will be apparent from and elucidated with reference to the embodiments described hereinafter.

Figure 1:
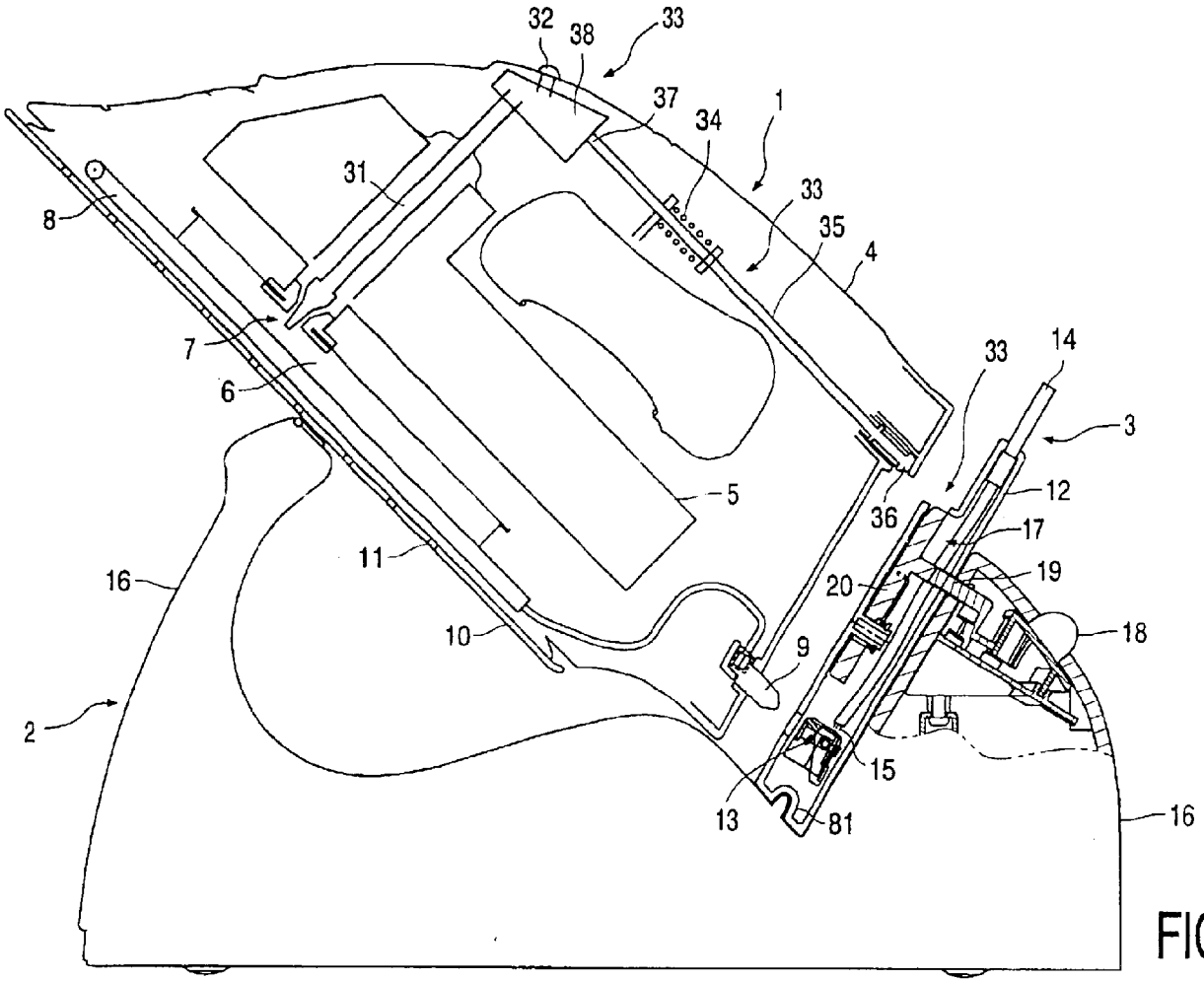
FIG. 1 shows an arrangement of an iron and a stand.
Figures 4A, 4B:
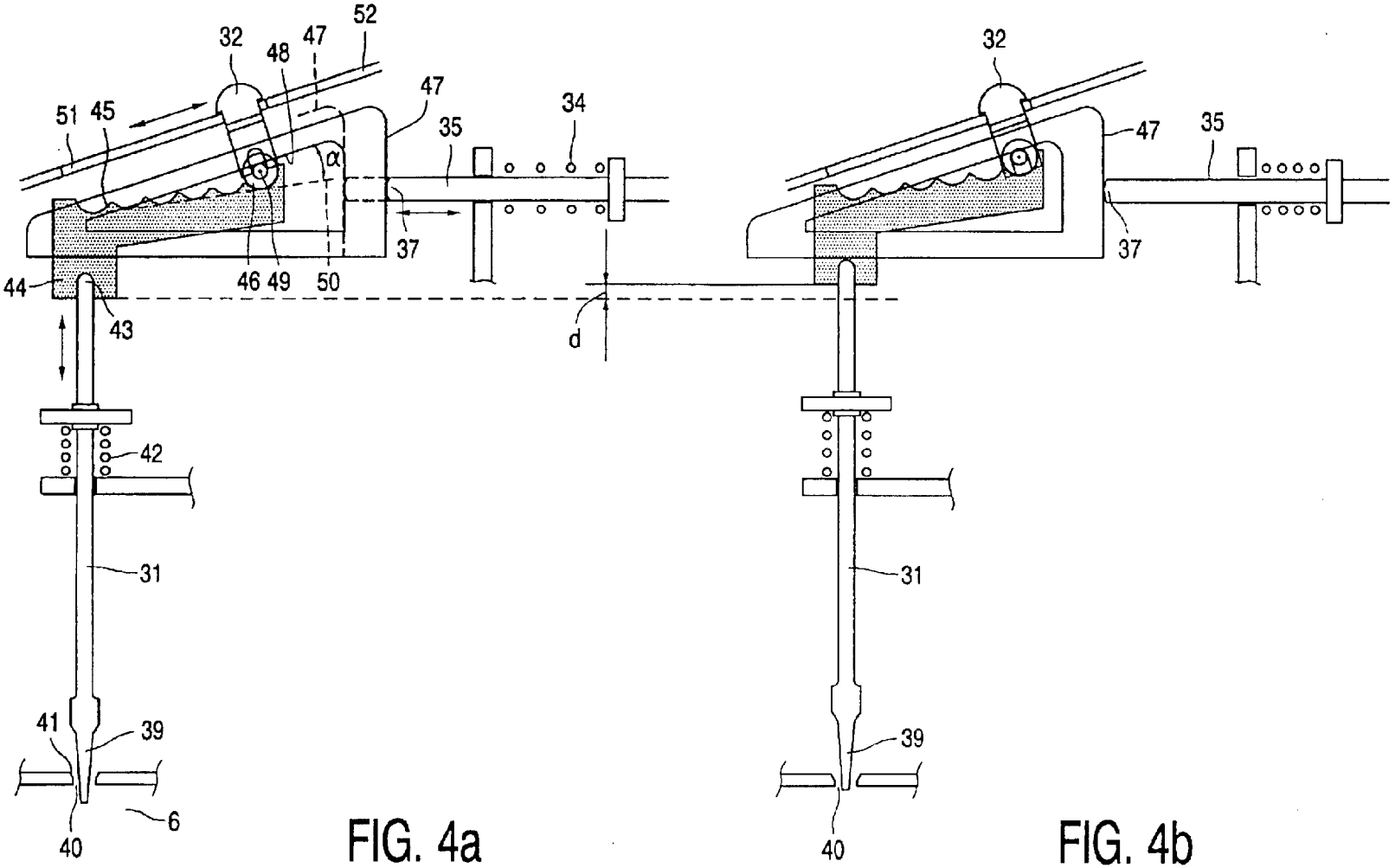
Figure 5:
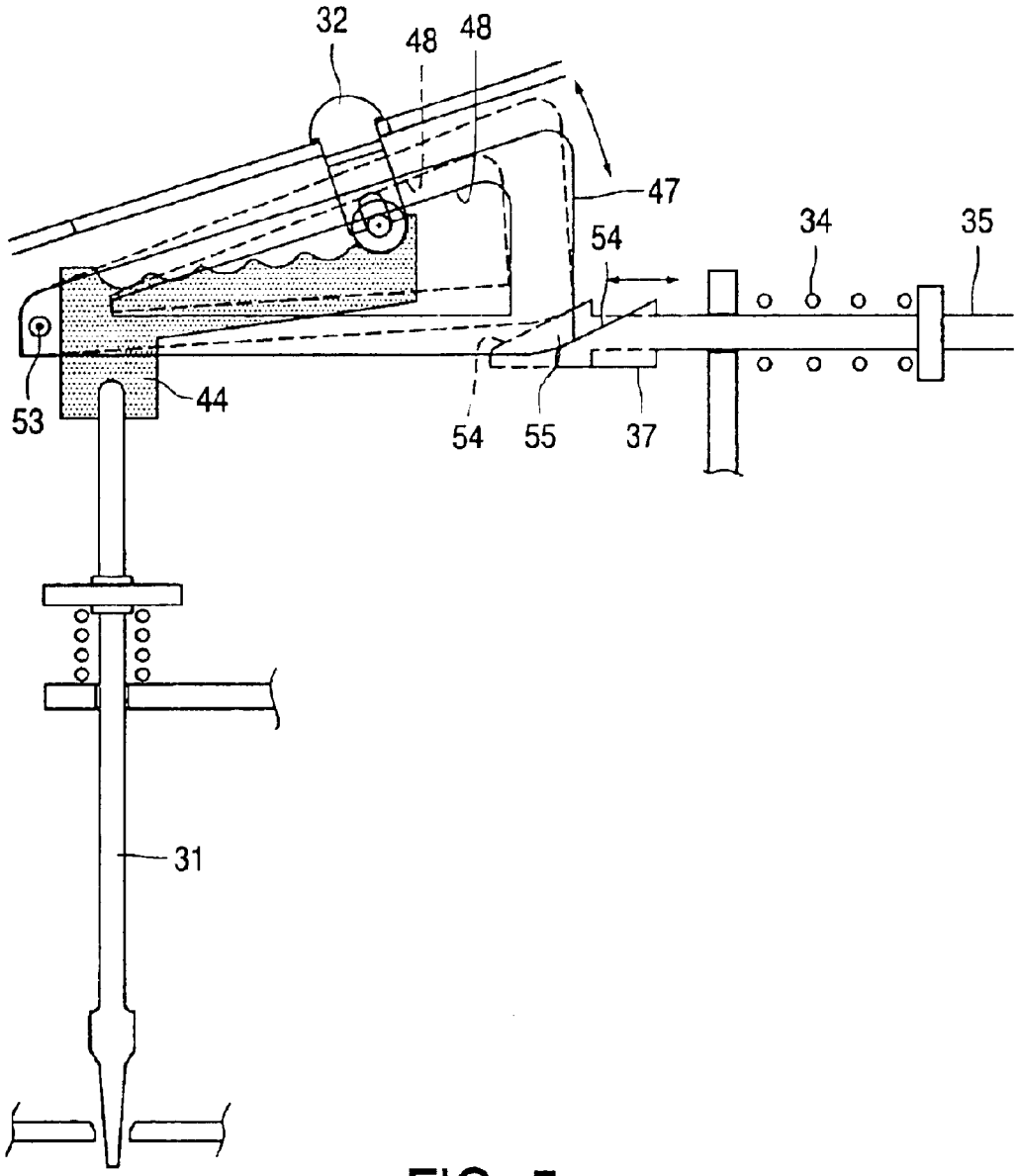
Figures 6A, 6B:
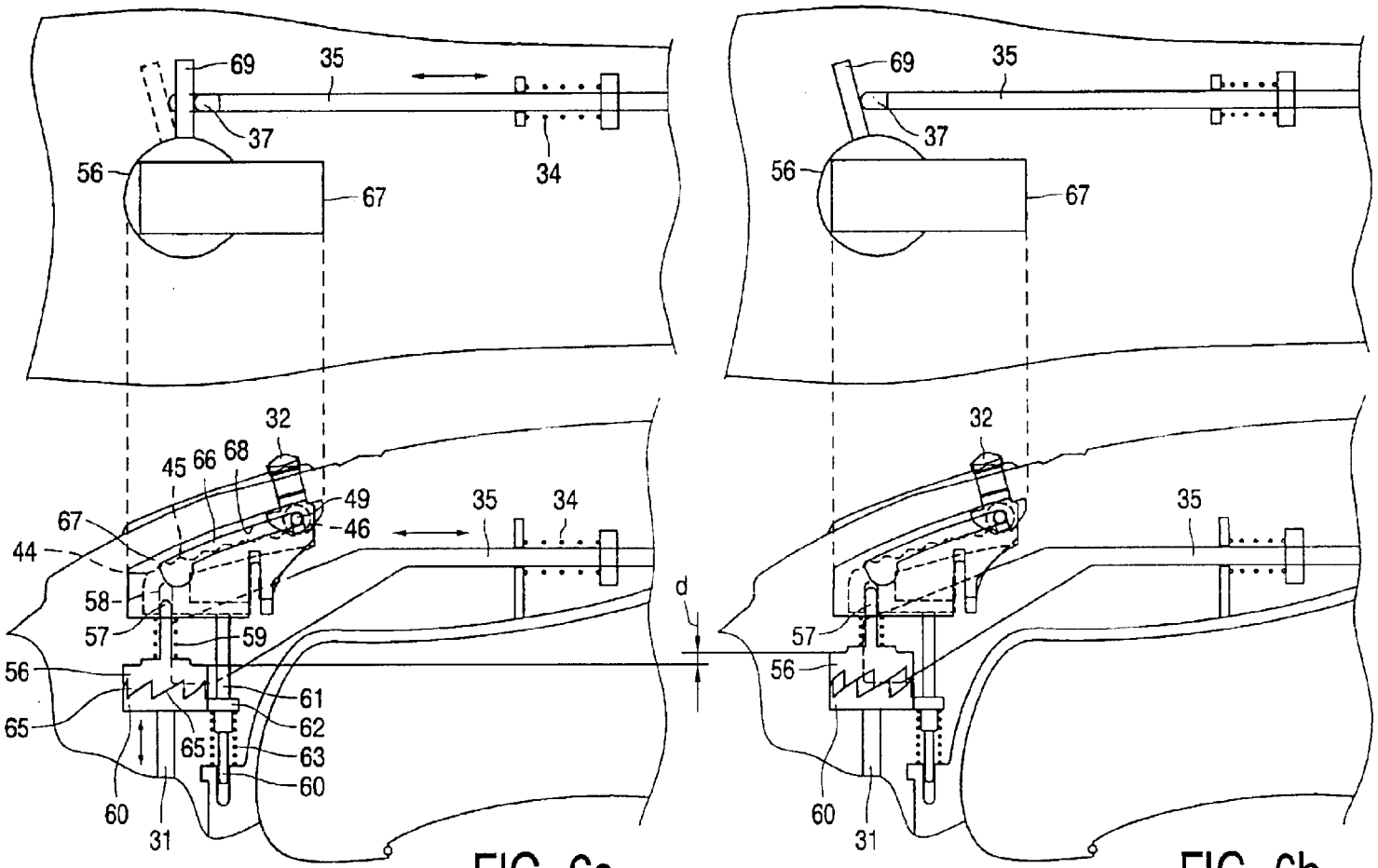
Figure 7A:
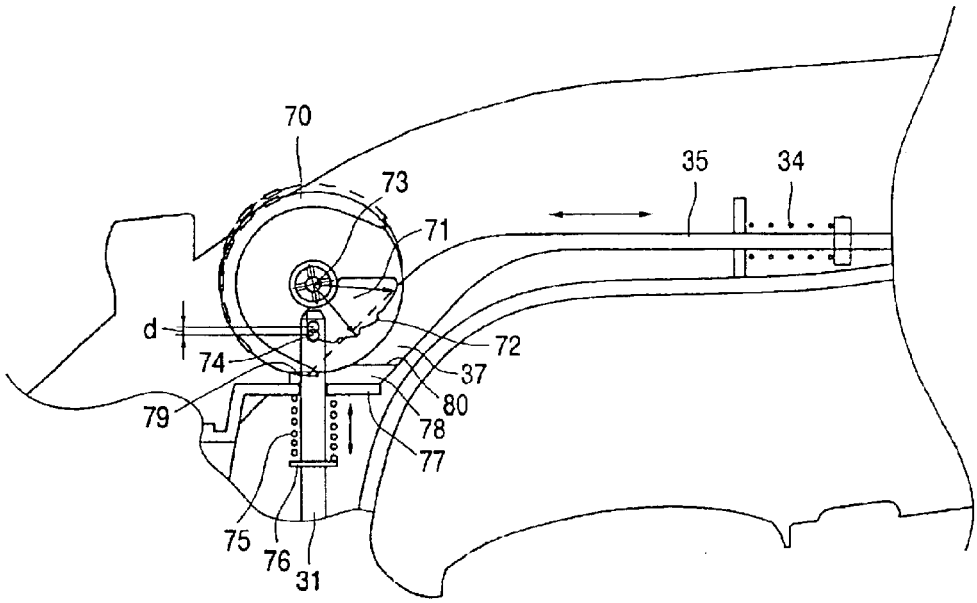
Figure 7B:
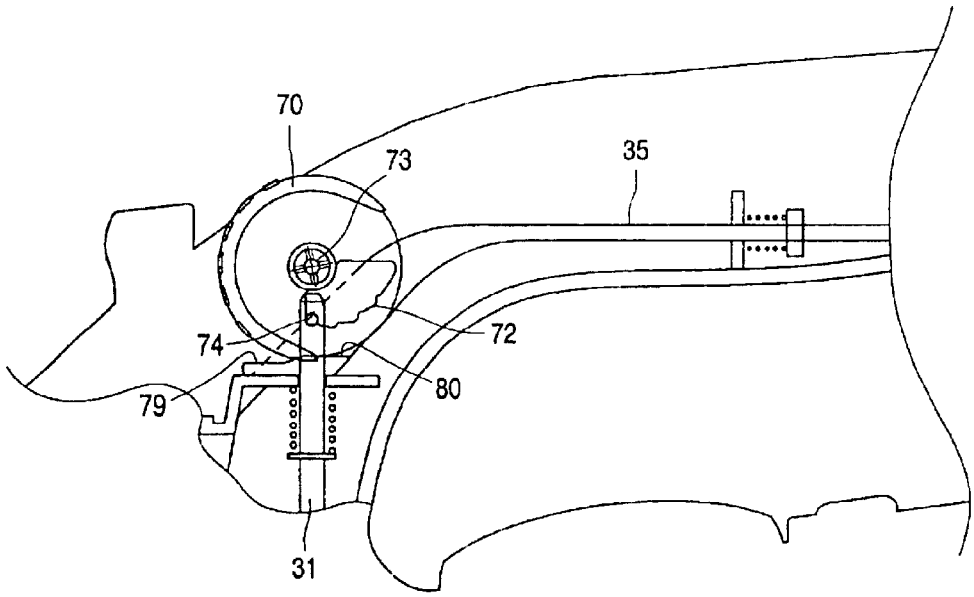

FIGS. 4*a* and 4*b* is a diagrammatic view of a first embodiment of the actuating means of the iron of FIG. 1, FIG. 5 is a diagrammatic view of a second embodiment of actuating means of the iron of FIG. 1 similar to FIG. 4*a*, FIGS. 6*a* and 6*b* show a third embodiment of the actuating means of the iron of FIG. 1, FIGS. 7*a* and 7*b* show a fourth embodiment of the actuating means of the iron of FIG. 1.

As is shown in FIG. 1, the iron arrangement comprises an iron 1, a stand 2 for supporting the iron when it is not in use, and an electrical connector 3. The iron has a housing 4 which accommodates a water tank 5, a steam chamber 6, valve means 7 for controlling the water flow from the water tank to the steam chamber, heating means 8 energizable through electrical contacts 9, and a soleplate 10 in which steam outlet apertures 11 are provided. The connector 3 has a housing 12, electrical contacts 13, and a power cord 14 whose electrical conductors 15 are connected to the contacts 13. The housing 4 of the iron 1 and the housing 12 of the connector 3 are shaped such that when they are placed against each other the electrical contacts 9 of the iron establish an electrical connection with the electrical contacts 13 of the connector. The stand comprises a housing 16 which is shaped to cooperate with the connector 3. The arrangement further comprises locking means 17 for locking the connector 3 either to the stand 2 or to the iron 1. For this purpose the stand comprises a switch 18 having a finger 19 which protrudes from the housing 16 of the stand into the housing 12 of the connector for cooperation with the locking means 17, as will be explained further below with reference to FIGS. 2 and 3.

Figure 2:
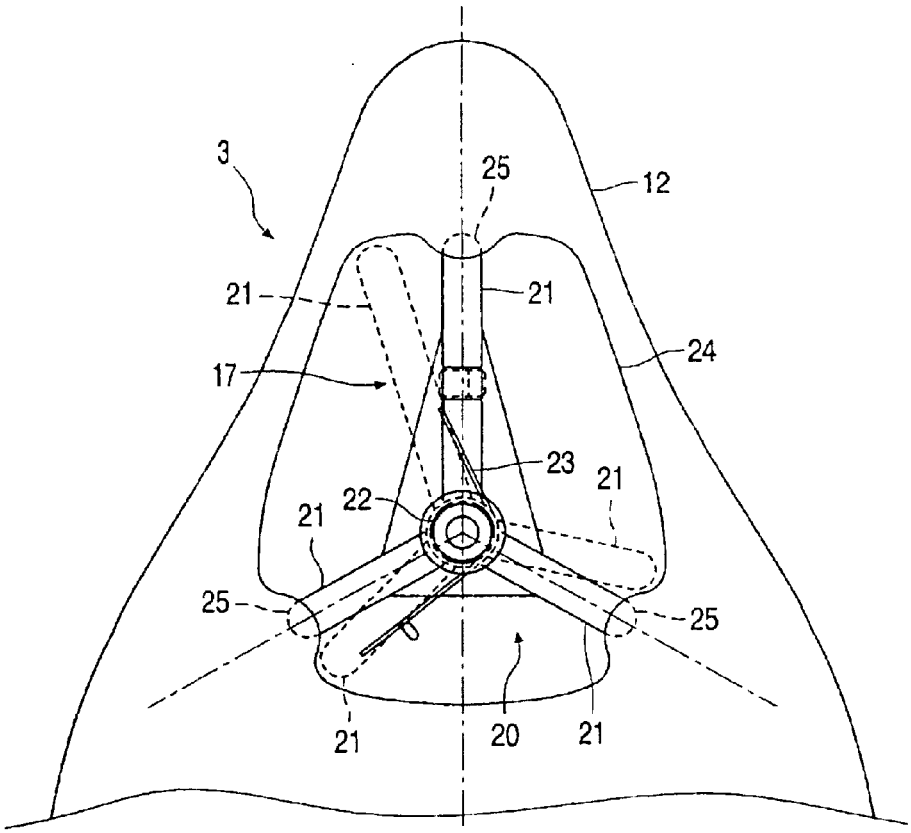
FIGS. 2 and 3 show a locking mechanism of the connector.
Figure 3:
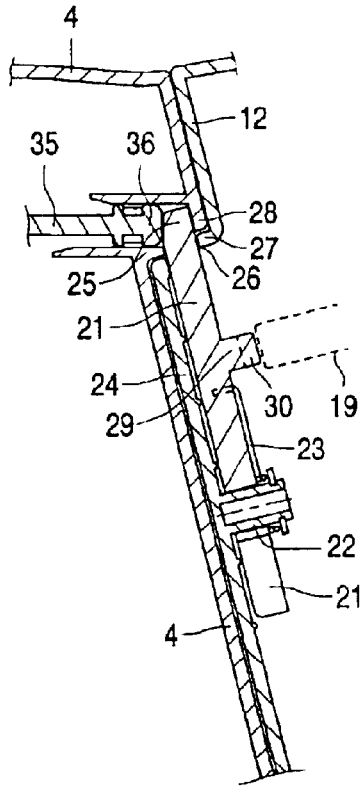

FIG. 2 is a plan view and FIG. 3 is a cross-sectional view of the connector 3. The locking means 17 comprise a pivotable latching body 20 having three latches 21 extending in three different directions, for example shifted through over 120° with respect to each other. The latching body 20 can pivot about a bearing shaft 22 of the housing 12 of the connector against the force of a torsion spring 23. The housing 12 has a protruding housing portion 24. In the corded mode, when the connector is attached to the iron, end portions 25 of the latches 21 protrude through openings 26 in side walls 27 (only one is shown in FIG. 3) of the housing portion 24 and are locked behind wall portions 28 of the housing 4 of the iron, as is shown in FIG. 3 and with solid lines in FIG. 2. Pivoting the latching body 20 counterclockwise against the force of the spring 23 causes the end portions 25 of the latches 21 to pivot away from the wall portions 28 (indicated with broken lines in FIG. 2), thereby unlatching the connector from the iron. Said pivoting can be actuated by means of the switch 18 on the stand. For that purpose one of the latches 21 of the latching body 20 is provided with a protrusion 29 with a beveled portion 30 opposite the finger 19. Moving the switch 18 in a direction perpendicular to the plane of the drawing (see FIG. 1) causes the finger 19 to push against the protrusion 29 and causes the latching body 20 to pivot against the force of the spring 23, thereby unlatching the connector from the iron as described above. Moving the switch 18 back again causes the finger 19 together with a hump 81 to lock the connector 3 to the stand 2.

As is shown in FIG. 1, the valve means 7 comprise a steam rod 31. A knob 32 on the housing 4 of the iron controls the movement of the steam rod. The arrangement is provided with actuating means 33 capable of acting on the valve means 7, in particular on the steam rod 31, such that when the corded mode is selected, i.e. when the connector 3 is attached to the iron and thus connected to the power source, the maximum water flow rate is higher than when the cordless mode is selected, i.e. when the connector 3 remains attached to the stand 2. For that purpose, the actuating means 33 comprise a push rod 35 loaded by a spring 34 which extends, for example, through the handle of the iron. One end 36 of this push rod 35 cooperates with the locking means 17, as will be explained below. The other end 37 acts on the steam rod 31 via a dosing mechanism 38, as will be explained now in the light of the diagrammatic drawings of FIGS. 4*a* and 4*b*.

As is shown in FIGS. 4*a* and 4*b* the steam rod 31 has a steam needle shaped as a tapered end portion 39 and is arranged in an opening 40 of a valve seat 41 which opens out into the steam chamber 6. The steam rod 31 is spring-loaded and can be moved up and down. A downward movement causes the spring 42 to be compressed. It will be clear that the position of the tapered end portion 39 in the opening 40 determines the size of the opening 40 and thus the flow rate of the water from the water tank 5 to the steam chamber 6. The end 43 of the steam rod remote from said tapered end portion 39 is connected to a dosing cam 44. This dosing cam has a corrugated wall 45 which cooperates with a freely rotatable roller 46 provided on the control knob 32. The actuating means further comprises a bracket 47 provided with a straight inclined wall 48. The axis 49 of the roller 46 cooperates with said wall 48, i.e. the axis 49 glides along wall 48. As is indicated in FIG. 4*a*, a line 50 defined by the bottoms of the corrugations of the corrugated wall 45 encloses a small angle $\alpha$ with the wall 48. As the steam rod 31 is constantly urged upwards by the spring 42, the axis 49 is constantly in contact with the wall 48. The knob 32 is shaped as a slide. Moving the slide 32 through a slot 51 in the wall 52 of the housing 4 will cause the roller 46 to seat in different corrugations of the corrugated wall 45, thereby causing an up and down movement of the dosing cam 44 and thus an up and down movement of the steam rod 31 with the tapered end portion 39. In this way the size of the opening 40 can be adjusted. FIG. 4*a* shows the situation for an iron arrangement in a cordless mode. The slider 32 is in its extreme right position with the steam rod 31 in its uppermost position, and thus the size of the opening is such that the flow rate of water is a maximum and the steam rate is maximum. Moving the bracket 47 to the left, in a direction perpendicular to the movement of the steam rod 31, causes the inclined wall 48 to move over the same distance to the left. The inclined wall 48 also moves upwards. This causes the dosing cam 44 also to move upwards under the influence of the spring 42. The axis 49 of the roller 46 can move upwards in the oblong recess of the knob 42 and thus remains in contact with the wall 48. So, without moving the slide 32 a displacement of the bracket 47 to the left causes the tapered end 39 of the steam rod to move upwards over a distance d resulting in a higher flow rate. This situation is shown in FIG. 4*b* and corresponds to the iron arrangement being in the corded mode. The bracket 47 is displaced by means of the push rod 35. A displacement of the push rod 35 to the left in FIG. 4*a* against the force of the spring 34 causes the end 37 of the push rod to push the bracket 47 to the left. Said displacement of the push rod is obtained when the connector 3 is attached to the iron, as can be seen in FIG. 3. As was explained above for the corded mode, the latching body 20 is pivoted clockwise, causing the end portions 25 of the latches 21 to protrude through openings 26 of the connector and hook behind a wall portion 28 of the iron housing. At the same time one of the end portions 25 pushes the end 36 of the push rod 35 to the left. A higher maximum flow rate is accordingly obtained compared with the cordless mode when the corded mode is selected.

FIG. 5 shows a second embodiment similar to that of FIG. 4*a*. The difference is that a displacement of the inclined wall 48 of the bracket 47 is now obtained by a pivoting movement of the bracket 47 about pivot point 53. It will be clear that pivoting the bracket 47 causes a vertical movement of the inclined wall 48 and thus a higher water flow rate, similar to what was described for the previous embodiment. The pivoting movement may be obtained, for example, by sliding an inclined wall 54 of the end 37 of the push rod 35 underneath a part 55 of the bracket remote from the pivot point 53.

In the third embodiment shown in FIGS. 6*a* and 6*b*, the steam rod 31 is provided with a ratchet 56 which is fixed on the steam rod. The upper end 57 of the steam rod is guided in a hole 58 of the dosing cam 44. A spring 59 is tensioned between the ratchet 56 and the dosing cam 44. The ratchet 56 is urged downward by the force of the spring 59. The ratchet 56 cooperates with a counter-ratchet 60 which can move along, but not rotate around the steam rod 31. The counter-ratchet 60 is secured to a shaft 61 by means of a bracket 62. The shaft 61 is fastened to the dosing cam 44. A spring 63 is tensioned between the bracket 62 and a fixed part 64 of the iron housing. So, the dosing cam 44 is urged upwards by the force of spring 63. The force of spring 63 is greater than that of spring 59. The two ratchets 56,60 are provided with cooperating teeth 65. The cooperating teeth always remain in contact with each other owing to the opposite forces of the springs. Steam rate control in the cordless mode as well as in the corded mode is performed by the slider 32. The axis 49 of the roller 46 is guided in the slot 66 of the fixed bracket 67 and is continuously in contact with the upperwall 68 of the slot 66 owing to the force of spring 63. The roller 46 moves along the corrugated surface 45 of the dosing cam 44, which causes an upward or a downward movement of the steam rod 31, depending on the direction of movement of the slider 32. FIG. 6*a* shows the situation for an arrangement in its cordless mode. The slider 32 is in its extreme right position with the steam rod 31 in its uppermost position, thus the size of the opening is such that the flow rate of water is a maximum and thus the steam rate is a maximum. The ratchet 56 is provided with a radially extending arm 69 for cooperation with the end 37 of the push rod 35. To select the corded mode, the connector 3 is attached to the iron, as a result of which the push rod 35 is pushed forward. The end 37 of the push rod 35 pushes against the arm, which causes a rotation of the ratchet 56. Owing to the inclined teeth 65, the ratchet 56 moves upward over a distance d together with the steam rod 31 and the dosing cam 44. The resulting situation is shown in FIG. 6*b*. Counter-ratchet 60 remains stationary. An upward movement of the dosing cam 44 is possible because the axis 49 of the roller 46 can move in the oblong recess of the sliding knob 32. As was explained above, an upward movement of the steam rod 31 causes a higher maximum steam rate.

In the fourth embodiment shown in FIGS. 7*a* and 7*b*, the iron is provided with a rotary knob 70 instead of a slider to adjust the steam rate. The rotary knob is provided with an opening 71 having a corrugated wall portion 72. The distance between the axis 73 of the rotary knob 70 and consecutive corrugations of the wall portion 72 decreases in clockwise direction. The steam rod 31 is provided with a pin 74 which cooperates with the corrugated wall portion 72. A compression spring 75 between a fixed ring 76 on the steam rod 31 and a fixed part 77 of the iron housing causes a constant push on the steam rod in the downward direction, so that the pin 74 always remains in contact with the corrugations of the corrugated wall portion 72. Turning the rotary knob 70 in clockwise direction causes a downward movement of the steam rod 31 and thus a lower steam rate. FIG. 7*a* shows the situation in which the arrangement is in its cordless mode. The steam rod 31 is in its uppermost position, thus the size of the opening is such that the flow rate of water is a maximum and thus the steam rate is a maximum. Seen in vertical direction, the end 37 of the push rod 35 is provided with a stepped portion 78 arranged between the lower side of the rotary knob 70 and a fixed housing part 77. The stepped portion 78 has two steps: a small step 79 and a large step 80 with an inclined surface between the steps. In the cordless mode of FIG. 7*a*, the small step 79 is accommodated between the lower side of the rotary knob 70 and the fixed housing part 77. To select the corded mode, the connector 3 is attached to the iron 1, which causes a forward movement of the push rod 35. The large step 80 of the push rod slides between the lower side of the rotary knob and the fixed housing part 77, causing an upward movement of the rotary knob 70 and thus lifting the steam rod 31 over a distance d (which corresponds to the difference in height between the steps 79 and 80) for obtaining a higher maximum steam rate. The resulting situation is shown in FIG. 7*b*. An upward movement of the rotary knob 70 is possible in that the axis 73 is guided into a vertical oblong recess (not indicated). To return to the cordless mode, the connector 3 is removed by attaching and locking it to the stand. The push rod 35 automatically returns to its initial position, and the small step 79 is again between the lower side of the rotary knob 70 and the fixed housing part 77. The steam rod 31 moves down into the position corresponding to its lower maximal steam rate.

All embodiments described above comprise a control knob for controlling the steam rate in the cordless mode as well as in the corded mode. It is also possible, however, to omit the control knob. This means that the arrangement has only two water flow rates, i.e. a high flow rate in the corded mode and a low flow rate in the cordless mode. In such an embodiment the push rod can be directly coupled to the steam rod. In the cordless mode the push rod is not activated and there is a low flow rate, whereas in the corded mode the push rod is moved forward by the attached connector and directly lifts the steam rod so as to obtain a high water flow rate.

In the embodiments described the steam rod performs a translatory movement to adjust the flow rate. It is also possible, however, to have the steam rod perform a rotary movement instead of a translatory movement. For that purpose, the steam needle and the valve seat are shaped with recesses such that upon rotation of the steam rod several sizes of through openings (passages) between the water tank and the steam chamber are obtained. Constructions of this kind are known per se.

What is claimed is:

1. An electric iron arrangement to be used as desired in either a corded mode or a cordless mode, the arrangement comprising an electric iron having a housing, a water tank, a steam chamber, valve means for controlling the water flow from the water tank to the steam chamber, actuating means acting on the valve means, and electrical contacts through which heating means of the iron can be energized, a stand for supporting the iron when not in use, an electrical connector having a housing, an electric power cord, and electrical contacts energizable by means of the power cord and constructed to cooperate with the electrical contacts of the iron when the iron and the connector are in an interengaged position, and locking means for locking the connector to the stand or to the iron, the arrangement being such that, when the cordless mode is selected, the electrical connector remains attached to the stand while the iron is detached therefrom, and when the corded mode is selected the connector attached to the iron and a portion of the electrical connector engages the actuating means thereby causing the actuating means to act on the valve means to obtain a higher maximum water flow rate than in the cordless mode.

2. An electric iron arrangement as claimed in claim 1, wherein the actuating means comprise a spring-loaded push rod arranged in the iron, one end thereof cooperating with the portion of the connector, the other end thereof cooperating with the valve means.

3. An electric iron arrangement as claimed in claim 2, wherein the locking means for the connector forms the portion.

4. An electric iron arrangement as claimed in claim 3, wherein the locking means comprise latches, each latch being movable through a corresponding opening in a housing of the connector inside a corresponding opening in the housing of the iron, and in that one of the latches forms the portion that cooperates with said one end of the push rod.

5. An electric iron arrangement as claimed in claim 2, wherein the valve means comprise a movable steam rod with a steam needle and a valve seat defining an opening in which the steam needle is inserted, the water flow from the water tank to the steam chamber being determined by the position of the steam needle in said opening, and the position of the steam needle being dependent on the position of the push rod.

6. An electric iron arrangement as claimed in claim 5, wherein the actuating means comprise converter means for converting the movement of the push rod into a translation or rotation of the steam rod.

7. An electric iron arrangement as claimed in claim 6, wherein said other end of the push rod comprises a stepped or beveled portion which acts on the steam rod for defining the position of said steam rod.

8. An electric iron arrangement as claimed in claim 1, wherein the water flow from the water tank to the steam chamber can be adjusted by means of a control knob both in the corded and the cordless mode.

9. An electric iron arrangement as claimed in claim 7, wherein the control knob is a rotatable knob having an inner corrugated wall portion for cooperation with the spring-loaded steam rod, said control knob together with the steam rod being adjustable in height by means of the stepped or beveled portion of the push rod.

10. An electric iron arrangement as claimed in claim 6, wherein the converter means comprise a movable bracket with an inclined wall portion and a dosing cam secured to the steam rod, and in that said dosing cam cooperates with said inclined wall portion via a control knob, said bracket being movable by means of the push rod.

11. An electric iron arrangement as claimed in claim 10, wherein said bracket is pivotable by means of the push rod.

12. An electric iron arrangement comprising:

an electric iron comprising:
- a water tank;
- a steam chamber;
- a valve for controlling the water flow from the water tank to the steam chamber; and
- an actuator for acting on the valve;

a stand for supporting the iron when not in use; and an electrical connector;

wherein the electrical connector, in a cordless mode, is detached from the iron, and in a corded mode the electrical connector is attached to the iron so that a portion of the electrical connector engages the actuator thereby causing the actuator to act on the valve to obtain a higher maximum water flow rate than in the cordless mode.

13. An electric iron comprising:

a water tank;

a steam chamber;

a valve for controlling the water flow from the water tank to the steam chamber;

an actuator for acting on the valve; and a detachable electrical connector, the electrical connector, in a cordless mode, being detached from the iron, and the electrical connector in a corded mode being attached to the iron so that a portion of the electrical connector engages the actuator thereby causing the actuator to act on the valve to obtain a higher maximum water flow rate than in the cordless mode.

* * * * *